US008529001B2

(12) United States Patent
Calvillo et al.

(10) Patent No.: US 8,529,001 B2
(45) Date of Patent: Sep. 10, 2013

(54) REFRIGERATOR WITH HEIGHT-ADJUSTABLE SHELF FOR REFRIGERATED GOODS

(75) Inventors: Juan Antonio Calvillo, Zaragoza (ES); Jürgen Fink, Gerstetten (DE); Bernd Pfister, Ulm (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/146,923

(22) PCT Filed: Jan. 27, 2010

(86) PCT No.: PCT/EP2010/050930

§ 371 (c)(1),
(2), (4) Date: Jul. 29, 2011

(87) PCT Pub. No.: WO2010/091955

PCT Pub. Date: Aug. 19, 2010

(65) Prior Publication Data

US 2011/0290807 A1 Dec. 1, 2011

(30) Foreign Application Priority Data

Feb. 13, 2009 (DE) ..... 10 2009 000 845

(51) Int. Cl.
*A47B 96/00* (2006.01)

(52) U.S. Cl.
USPC ..... 312/408

(58) Field of Classification Search
USPC ..... 312/408, 306, 401, 410, 312, 319.5, 312/319.7; 108/106–110, 147, 147.11, 147.12, 108/147.15–147.17
See application file for complete search history.

(56) References Cited

U.S. PATENT DOCUMENTS

| | | | | | |
|---|---|---|---|---|---|
| 97,489 | A | * | 12/1869 | Edson | 185/267 |
| 104,161 | A | * | 6/1870 | Johnson | 108/147 |
| 128,775 | A | * | 7/1872 | Archer | 108/147 |
| 603,148 | A | * | 4/1898 | Meyrowitz | 108/147 |
| 1,556,711 | A | * | 10/1925 | Pietrzycki | 312/107 |
| 2,841,459 | A | * | 7/1958 | Sharpe | 312/306 |
| 2,978,113 | A | * | 4/1961 | Anderson et al. | 312/306 |
| 3,188,161 | A | * | 6/1965 | Powder | 312/306 |
| 3,885,846 | A | * | 5/1975 | Chuang et al. | 312/306 |
| 3,982,801 | A | * | 9/1976 | Heidorn et al. | 312/306 |
| 4,217,010 | A | * | 8/1980 | Webb | 312/407 |
| 4,690,362 | A | * | 9/1987 | Helgeland | 248/404 |

(Continued)

FOREIGN PATENT DOCUMENTS

| | | | |
|---|---|---|---|
| JP | 3170780 | A | 7/1991 |
| JP | 6034265 | A | 2/1994 |

(Continued)

OTHER PUBLICATIONS

International Search Report PCT/EP2010/050930.

*Primary Examiner* — James O Hansen
(74) *Attorney, Agent, or Firm* — James E. Howard; Andre Pallapies

(57) ABSTRACT

A refrigeration appliance includes a housing and toothed profiles which are fixed to the housing. A height-adjustable shelf for refrigerated goods is received in the housing. The shelf has two rotatably drivable screws in engagement with the toothed profiles such that a storage surface of the shelf is held at least approximately in a horizontal orientation.

15 Claims, 4 Drawing Sheets

(56) References Cited

U.S. PATENT DOCUMENTS

| | | | | |
|---|---|---|---|---|
| 5,199,778 | A * | 4/1993 | Aoki et al. | 312/408 |
| 5,743,193 | A * | 4/1998 | Kakuta et al. | 108/147 |
| 5,913,584 | A * | 6/1999 | Swindell et al. | 312/408 |
| 6,065,821 | A * | 5/2000 | Anderson et al. | 312/408 |
| 7,121,602 | B2 * | 10/2006 | Queveau et al. | 296/24.44 |
| 7,178,890 | B2 * | 2/2007 | Park et al. | 312/408 |
| 8,152,258 | B2 * | 4/2012 | Kang et al. | 312/408 |
| 2008/0203041 | A1 * | 8/2008 | Lim et al. | 211/119.003 |
| 2008/0246382 | A1 * | 10/2008 | Kang et al. | 312/408 |
| 2008/0251483 | A1 * | 10/2008 | Davis et al. | 211/187 |

FOREIGN PATENT DOCUMENTS

| | | | |
|---|---|---|---|
| JP | 2004286411 | A | 10/2004 |
| WO | WO 2008062965 | A1 * | 5/2008 |
| WO | 2009000688 | A1 | 12/2008 |
| WO | WO 2010054683 | A1 * | 5/2010 |

* cited by examiner

REFRIGERATOR WITH HEIGHT-ADJUSTABLE SHELF FOR REFRIGERATED GOODS

BACKGROUND OF THE INVENTION

The invention relates to a refrigeration appliance, in particular a household refrigeration appliance, having a housing and a shelf for refrigerated goods, the height of which can be adjusted in the housing.

Refrigeration appliances with horizontal guide grooves positioned at different heights on the side walls of the interior, into which guide grooves shelves for refrigerated goods can be introduced, are widely available on the market. Such a design allows the height of the compartments bounded by the shelves to be varied in each instance but only in discrete steps corresponding to the distance between the grooves. Height adjustment is laborious and time-consuming, since a shelf that is to be moved has to be emptied before it is pulled out and then refilled once it has been repositioned.

The refrigeration appliance described in the unprepublished German patent application DE 10 2007 029 176 A1 was designed to permit easy height-adjustment of a shelf for refrigerated goods without having to empty it beforehand. In this refrigeration appliance a shelf for refrigerated goods is supported by way of screws disposed at its corners on toothed profiles, which are permanently attached to an interior wall of the refrigeration appliance. The rotating bodies can be driven rotationally by way of a handle attached to the front edge of the shelf for refrigerated goods to adjust the height of the shelf for refrigerated goods.

The four rotating bodies of such a shelf for refrigerated goods have to be coupled to one another to ensure that all four corners of the shelf for refrigerated goods are displaced in the same manner and that the shelf for refrigerated goods does not tilt. The space required to integrate such a coupling is no longer available for the accommodation of refrigerated goods. To implement the height adjustment, a large number of different components are required, the manufacture and assembly of which increase the manufacturing costs of the refrigeration appliance.

BRIEF SUMMARY OF THE INVENTION

The object of the invention is to create a refrigeration appliance with an infinitely height-adjustable shelf for refrigerated goods, with which the space requirement and the complexity of a drive mechanism for height adjustment purposes are reduced.

The object is achieved in that with a refrigeration appliance having a housing and a shelf for refrigerated goods, the height of which can be adjusted in the housing, wherein at least one rotationally drivable screw of the shelf for refrigerated goods engages with at least one toothed profile fixed to the housing, the shelf for refrigerated goods is supported by way of a total of two screws on the housing in such a manner that its storage surface is disposed at least approximately horizontally.

The screws can be positioned on the shelf for refrigerated goods in such a manner that a vertical plane running through the axes of the screws contains the center of gravity of the support for refrigerated goods. To keep stable an arrangement of the center of gravity that is offset in respect of this plane, the support for refrigerated goods is preferably held in such a manner that it can be adjusted vertically in at least one guide rail that is fixed to the housing.

The guide rail can take on the guide function of one or more of the screws of the structure described in DE 10 2007 029 176 A1, so that the remaining screws can have the same positions as the screws shown there, at corners of the support for refrigerated goods. The maximum number of toothed profiles is 2 to correspond to the reduced number of screws.

These two toothed profiles are preferably disposed adjacent to an identical edge of the shelf for refrigerated goods. A significant torque occurs at the shelf for refrigerated goods, when it is supported vertically only by the two toothed profiles, due to its inherent weight and the weight of any refrigerated goods positioned thereon, but this torque can be absorbed with the aid of the guide rail so that the shelf for refrigerated goods still remains stable.

The positioning of the two toothed profiles adjacent to an identical edge of the shelf for refrigerated goods allows a transmission housing for a transmission coupling the screws to one another to be accommodated in a housing that extends in a space-saving manner just along this edge.

Said edge is expediently the rear edge of the shelf for refrigerated goods, both from a static point of view and in respect of the capacity for use of the interior of the housing.

In order to be able to drive the screws, a pivot arm preferably extends below a plate of the shelf for refrigerated goods up to its front edge, where it is easily accessible for a user.

The pivot arm is preferably coupled to the screws by way of a ratchet mechanism, so that the shelf for refrigerated goods can be moved over a large distance in a single, selectable direction by means of several to and fro movements of the pivot arm.

This ratchet mechanism can be directionally adjustable; this allows all the freedom of movement of the pivot arm to be utilized to drive a height adjustment in a single direction.

Alternatively the pivot arm can be able to be deflected out of a rest position in opposing directions, with the movement of the pivot arm on a first side of the rest position driving an upward movement of the support for refrigerated goods and the movement of the pivot arm on an opposite, second side of the rest position driving a downward movement of the support for refrigerated goods.

The two toothed profiles are preferably introduced in a space-saving manner into edges of the interior, between the rear wall and side walls of the housing.

Instead of projections projecting into the interior, such a toothed profile can expediently have cutouts to receive a turn of the screw in each instance in a flat outer surface facing the shelf for refrigerated goods.

To stabilize the support for refrigerated goods and in particular to absorb a torque acting thereon and at the same time to keep the friction to be overcome during the height adjustment low, the guide rail preferably has at least one surface opposite the toothed profile, on which at least one roller of the support for refrigerated goods rests. The roller permits the transmission of a considerable force in a horizontal direction, to compensate for the torque, without the height adjustment of the support for refrigerated goods being blocked by excessive friction between the support for refrigerated goods and the guide rail.

It is particularly preferable for the guide rail to feature two mutually opposing surfaces, with at least one roller of the support for refrigerated goods resting on each. This allows the support for refrigerated goods to be guided in a largely play-free, low-friction manner.

If the rollers that rest on different surfaces of the guide rail are also offset in relation to one another in respect of height, the rollers also permit relief for the screws and guide rails in respect of horizontal forces, thereby reducing the friction occurring during the height adjustment.

The guide rail is preferably a rib or groove that extends along a side wall of the housing. The opposing surfaces of the guide rail are then expediently side faces of the rib or groove.

A support profile featuring the guide rail and toothed profile can expediently be fitted on an edge between the rear wall and a side wall of the housing. This permits horizontal forces, which act between the shelf for refrigerated goods on the one hand and the guide rail or its toothed profile on the other hand, to be absorbed in the support profile and be compensated for, so that more stringent requirements do not have to be set for the bearing capacity of the housing walls.

BRIEF DESCRIPTION OF THE DRAWINGS

Further features and advantages of the invention will emerge from the description which follows of exemplary embodiments with reference to the accompanying figures, in which.

DETAILED DESCRIPTION OF EXEMPLARY EMBODIMENTS OF THE PRESENT INVENTION

Figure 1:
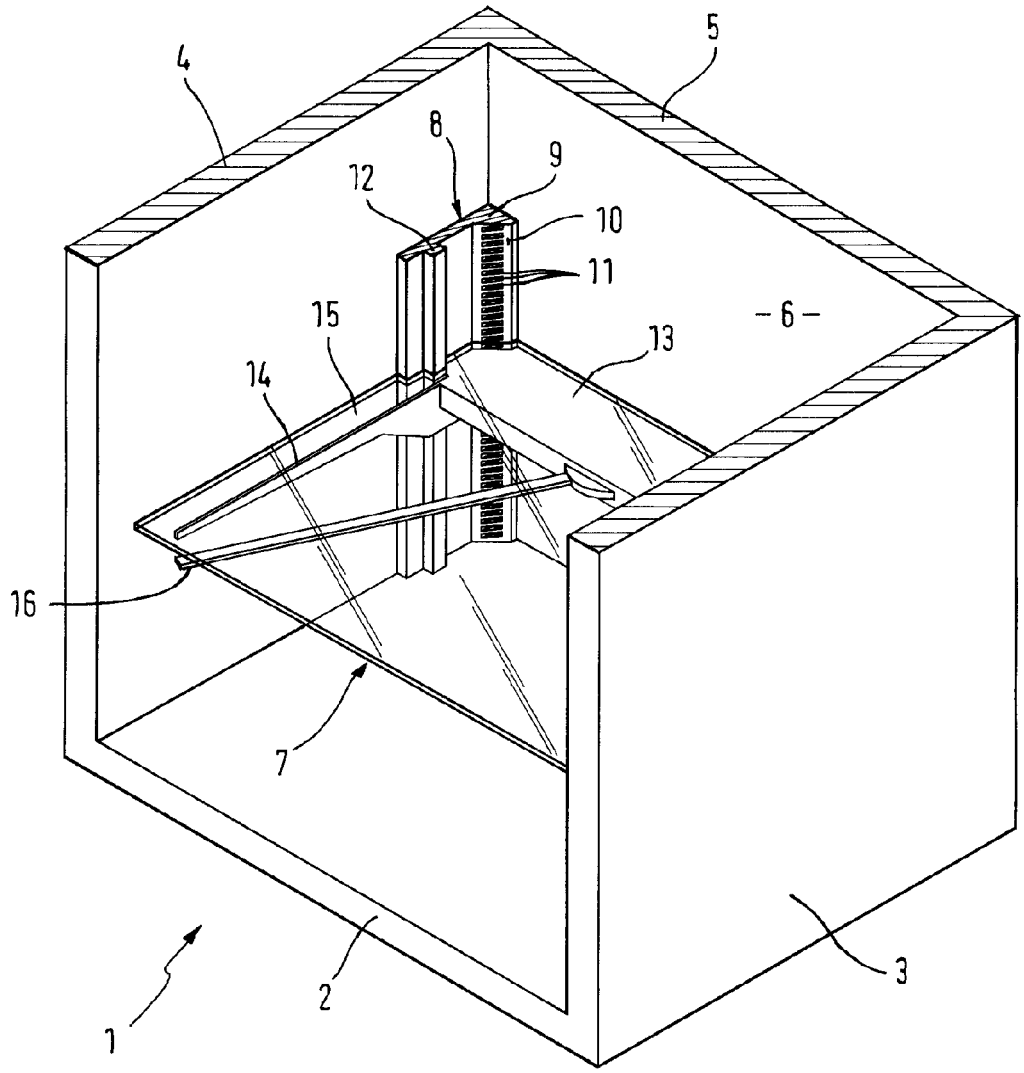
FIG. 1 shows a perspective, partially sectional view of a refrigeration appliance carcass with a height-adjustable shelf for refrigerated goods according to the invention.

FIG. 1 shows a perspective view of a section through a carcass 1 of a refrigeration appliance according to a first embodiment of the invention. It shows a base 2 and the lower halves of side walls 3, 4 and a rear wall 5 of the carcass 1. The top of the carcass 1 is not shown, nor is a door, which is generally hinged to the carcass 1 to close off its open front face.

Shown in the interior 6 of the carcass 1 is a single height-adjustable shelf for refrigerated goods 7 but it is evident that a number of shelves for refrigerated goods 7 can be provided one above the other. The shelf for refrigerated goods 7 is supported by two support profiles 8, only one of which is visible in FIG. 1 and which are disposed opposite one another with mirror symmetry, each on an edge of the interior 6 between the rear wall 5 and the side walls 3 and 4. The support profile 8 comprises a toothed profile 9, which fills the edge of the housing, with a longitudinally extended planar surface 10, which is at an angle of approx. 135° in each instance to the two adjacent walls 1 of the carcass, and a plurality of cutouts 11 let into the planar surface 10. A vertical rib 12 is formed on a limb of the support profile 8 extending along the side wall 3.

Screws—not visible in FIG. 1—that engage in the cutouts 11 of the two support profiles 8 and can be rotated in each instance coupled into a vertical axis are accommodated in a housing 13, which extends along a rear edge of the shelf for refrigerated goods 7 between the opposing support profiles 8. Two narrow arms 14, which extend forward from the housing 13 each narrowly adjacent and parallel to a side wall 3 or 4, support a glass plate 15 of the shelf for refrigerated goods 7.

A pivot arm 16, which drives the screws by way of a ratchet mechanism accommodated in the housing 13 extends forward below the glass plate 15. The direction of the ratchet mechanism can be adjusted in the known manner so that optionally for example a rotation of the pivot arm 16 in the clockwise direction drives an upward movement of the support for refrigerated goods 7 and a rotation of the pivot arm 16 leaves the support for refrigerated goods 7 unmoved, or the rotation in the counterclockwise direction leaves the support for refrigerated goods 7 unmoved, while the rotation in the counterclockwise direction drives a downward movement of the support for refrigerated goods. The length of the pivot arm 16 is dimensioned so that its front tip projects beyond the front edge of the glass plate 15 in any position it can assume, without however—at least in a position widely out to the side as shown in FIG. 1—preventing the door closing. The pivot arm 16 can be guided in a horizontal rail in proximity to the front edge of the glass plate 15 for stabilization, e.g. in a slot in a web (not shown in FIG. 1) connecting the front tips of the arms 14 together.

Figure 2:
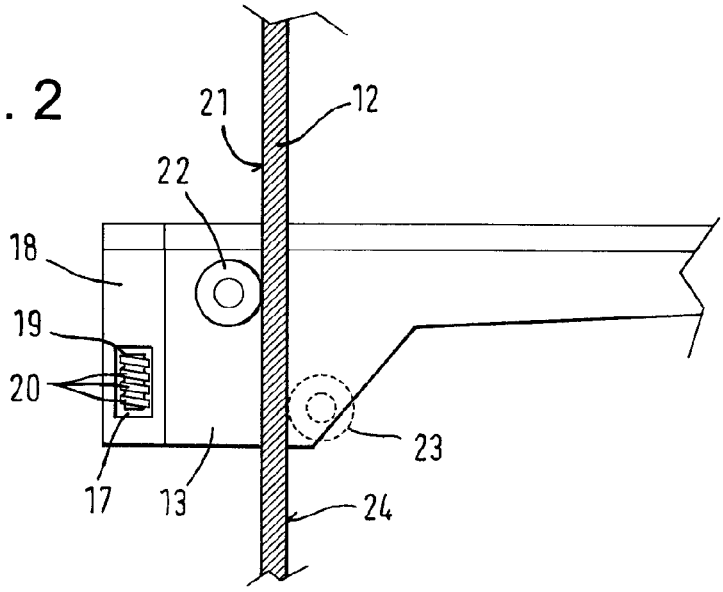
FIG. 2 shows a partial side view of the shelf for refrigerated goods according to a first development of the invention.

FIG. 2 shows a side view of the shelf for refrigerated goods 7 according to a first development of the embodiment in FIG. 1. A vertical hatched bar in FIG. 2 is the rib 12 of the support profile 8 shown in cross section in this figure. One of the abovementioned two screws, here marked 19, the turns 20 of which engage in the cutouts 11 of the toothed profile, can be seen in a window 17 in an angled wall 18 of the housing 13 facing the planar surface 10. The engagement of the screws 19 permits the two support profiles 8 to absorb the weight of the shelf for refrigerated goods 7 but the shelf for refrigerated goods 7 is supported some distance away from its center of gravity so that the resulting torque has to be absorbed. In the simplest instance a projection of the housing 13 could be used for this, resting on a side 21 of the rib 12 facing the planar surface 10 above the screw 19.

Because the projection and the screw 19 each transmit horizontal forces of opposing orientations to the rib 12 or the toothed profile 9, it is possible to compensate for the torque but at the price of considerable friction between the surfaces of the projection and rib 12 or screw 19 and toothed profile 9 that are moved toward one another.

Such friction can largely be prevented on the part of the rib 12 in that a roller 22 presses against the side 21 rather than a rigid projection, as shown in FIG. 2.

In order also to relieve excessive friction on the screw 19 and toothed profile 9, according to one expedient development a second roller 23 is disposed on the housing 13 below the first roller 22, which presses the side 24 of the rib 12 opposite the side 21.

Figure 3:
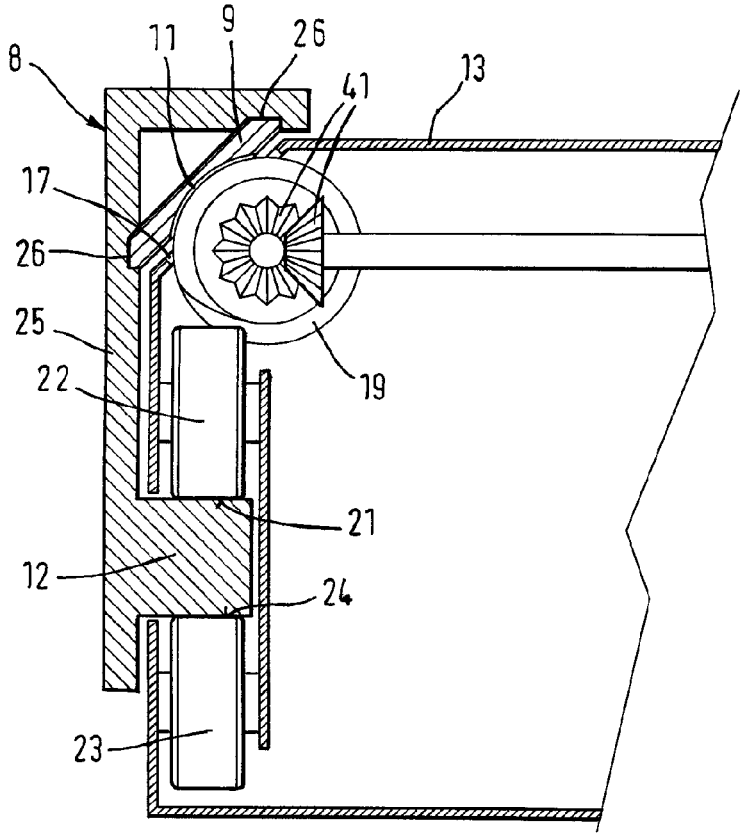
FIG. 3 shows a horizontal partial section through the transmission housing and a support profile according to a second development.

A development illustrated in FIG. 3 based on a horizontal section through the housing 13 functions mechanically in the same manner as the one in FIG. 2. As with this latter rollers 22, 23 with a height offset rest on opposing sides 21, 24 of the rib 12, such that they are also offset from one another with regard to their vertical centerlines such that the two rollers do not substantially overlap one another when viewed from a vertical direction. The difference from FIG. 2 is that instead of being positioned on one side in a floating manner on the outside of the housing 13, the rollers 22, 23 are accommodated inside the housing 13 with axes fixed on two sides and the rib 12 engages through a vertical slot housing between the rollers 23, 24.

Two engaging bevel wheels 41 connect the screw 19 to the ratchet mechanism disposed in the center of the housing 13.

As also shown in FIG. 3 the support profile is in two parts, having a basic profile 25 that is extrusion molded in a simple and low cost manner and has a cross section that remains the same and the toothed profile 9, which is manufactured separately from the basic profile 25 and is introduced into its grooves 26.

Figure 4:
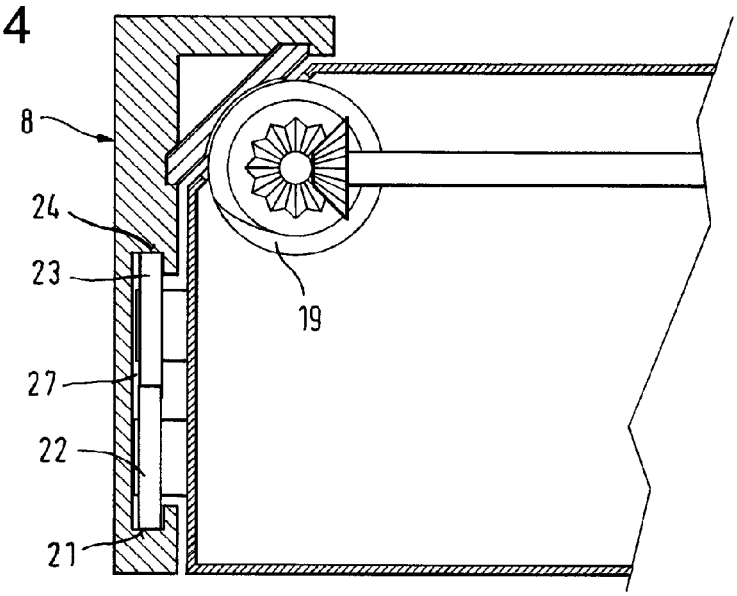
FIG. 4 shows a section like the one in FIG. 3 according to a third development.

FIG. 4 shows an alternative development of the embodiment in FIG. 1, in which the mutually height-offset rollers 22, 23 of the shelf for refrigerated goods 7 rest on opposing sides 21, 24 of a groove 27 of the support profile 8.

Figure 5:
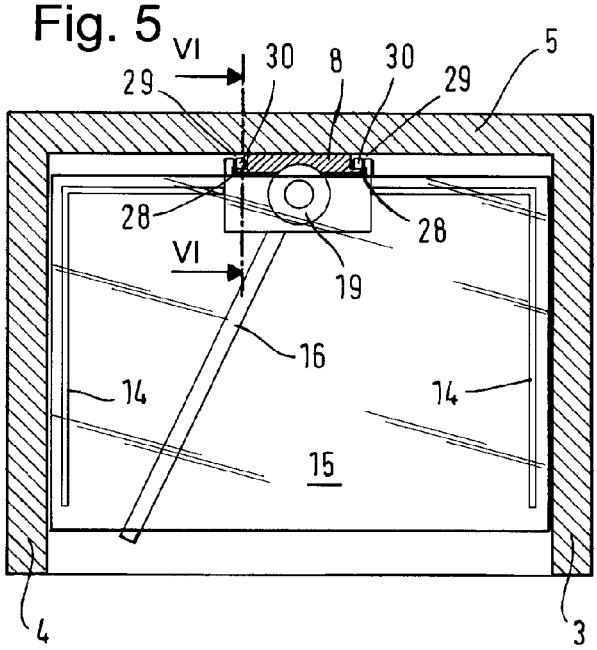
FIG. 5 shows a horizontal section through a refrigeration appliance according to a second embodiment of the invention.

A second embodiment, which uses a single support profile 8 positioned centrally on the rear wall 5 of the carcass 1, is shown in FIG. 5 based on a horizontal section through a refrigeration appliance carcass. Since in this embodiment only a single screw 19 is present, no space is required for a coupling mechanism. The housing 13 must only provide space for the screw 19 and the ratchet mechanism driven by the pivot arm 16 and therefore does not extend from one side wall 3 to the other 4.

Figure 6:
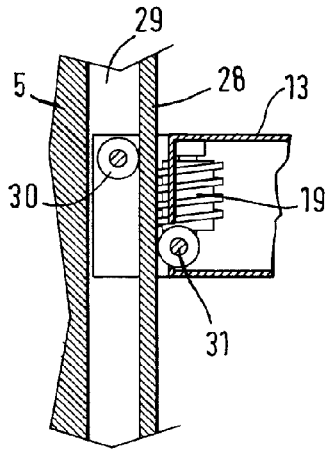
FIG. 6 shows a section along the plane marked VI-VI in FIG. 5.

A vertical guide rail is formed here by two ribs 28 that widen the toothed profile 9 and grooves 29 bounded between these and the rear wall 5 and open to the side in each instance. Rollers 30 supported by side walls of the housing 13 engage in these grooves 29. Rollers 31 concealed in the interior of the housing 13 rest—with a height offset in respect of the rollers 30 as shown in the vertical section in FIG. 6—on a front face of the ribs 28. The roller pairs 30, 31 thus compensate for the torque of the shelf for refrigerated goods 7 and the screw 19 can be rotated with little friction.

Figure 7:
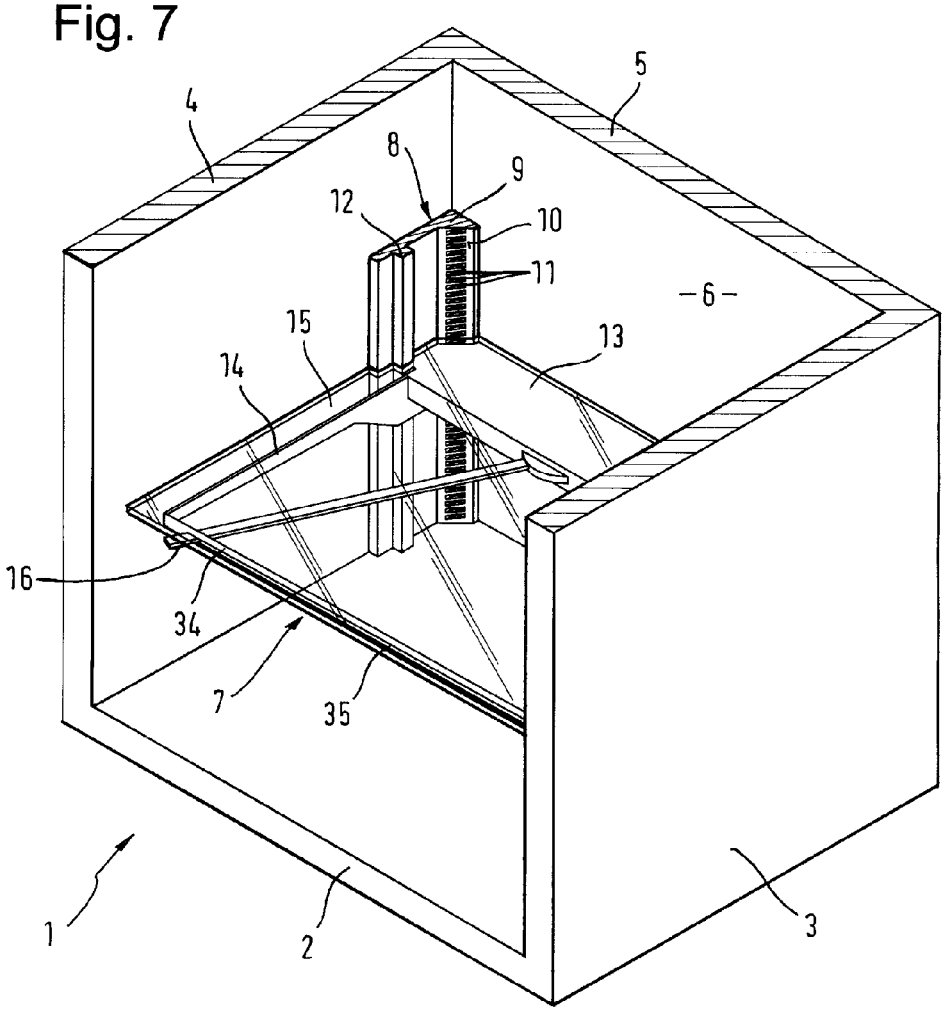
FIG. 7 shows a section like the one in FIG. 1 according to a third embodiment.

A third embodiment shown in FIG. 7 differs essentially from the one in FIG. 1 only in the ratchet mechanism and the pivot lever driving it. While in FIG. 1 the pivot lever can be moved continuously between two stops and over this entire movement, depending on the direction, either operates without load or drives an adjusting movement of the support for refrigerated goods in a uniform direction, the pivot lever 16 according to the third embodiment has a rest position, in which it projects forward from the housing 13 in a perpendicular manner and from which it can be deflected to the left or right against a reset spring, e.g. as far as the stop position shown in FIG. 7. Each rotation of the pivot lever out of the rest position drives a height adjustment of the support for refrigerated goods 7, up or down depending on the rotation direction, while a reset movement of the pivot lever 16 back to the rest position drives the height of the pivot lever out of the rest position or leaves a height adjustment of the support for refrigerated goods unchanged.

Figure 8:
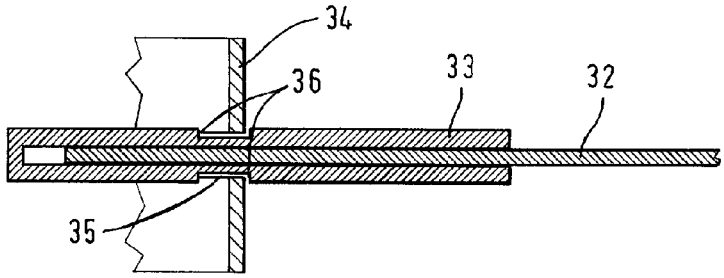
FIG. 8 shows an enlarged detail of the third embodiment in cross section.

In order to be able to close the door of the refrigeration appliance in the rest position, but on the other hand also to be able to grip the tip of the pivot lever 16 in the stop position, the length of said pivot lever 16 can be adjusted, as shown in the longitudinal section of the lever in FIG. 8, due to a telescopic structure of the level with a rod-type base segment 32 connected rigidly to the ratchet mechanism and a handle shaft 33 pushed onto it. The handle shaft 33 crosses a horizontally extended slot 35 in a stirrup 34 connecting the front ends of the support arms 14 and features contours, in the form of two grooves 36 here, in which the edges of the slot 35 engage to control the displacement of the handle shaft 33 along the base segment 32 according to the rotation of the lever 16.

The invention claimed is:

1. A refrigeration appliance, comprising:

a housing;

a first support profile and a second support profile disposed opposite one another and fixed to the housing, wherein the first and second support profiles each comprise a toothed profile comprising cutouts;

a height-adjustable shelf received in the housing for refrigerated goods, said shelf having a first rotatably drivable screw in engagement with the cutouts of the toothed profile of the first support profile and a second rotatably drivable screw in engagement with the cutouts of the toothed profile of the second support profile such that a storage surface of the shelf is held at least approximately in a horizontal orientation, and wherein the toothed profiles of the first and second support profiles are disposed adjacent to an edge of the shelf;

at least one guide formed on each of the first support profile and the second support profile to support the shelf during adjustment of the shelf, wherein the guide has two mutually opposing surfaces;

a pivot lever extending forward below the shelf and having a length such that a front most tip of the pivot lever projects beyond a front edge of the shelf in any position the pivot lever assumes, wherein the pivot lever is coupled to the first and second rotatably drivable screws for driving the first and second rotatably drivable screws; and two rollers respectively resting on the two surfaces, wherein the two rollers are offset from one another as to height and are offset from one another as to their vertical centerlines such that the two rollers do not substantially overlap one another when viewed from a vertical direction and wherein the two rollers are substantially aligned in the horizontal direction when viewed from a top down perspective.

2. The refrigeration appliance of claim 1, constructed in the form of a household refrigeration appliance.

3. The refrigeration appliance of claim 1, further comprising a transmission housing extending along an edge of the shelf between the first and second rotatably drivable screws which are in engagement with the toothed profiles.

4. The refrigeration appliance of claim 1, wherein the edge is a rear edge of the shelf.

5. The refrigeration appliance of claim 1, wherein the shelf further comprises a plate defining a front edge, and the pivot lever extends below the plate of the shelf up to the front edge of the plate.

6. The refrigeration appliance of claim 1, further comprising a directionally adjustable ratchet mechanism, wherein the pivot lever is coupled to the first and second rotatably drivable screws via the directionally adjustable ratchet mechanism.

7. The refrigeration appliance of claim 1, wherein the first support profile and the second support profile having the toothed profiles are positioned in edges between a rear wall and side walls of the housing.

8. The refrigeration appliance of claim 1, wherein the first support profile and the second support profile having the toothed profiles have a flat outer surface which faces the shelf and has the cutouts thereon for receiving a turn of the first and second rotatably drivable screws.

9. The refrigeration appliance of claim 1, wherein one of the two opposing surfaces of the guide is opposite to a respective one of the toothed profiles, said shelf having at least one of the two rollers resting on the surface of the guide opposite to the respective one of the toothed profiles.

10. The refrigeration appliance of claim 1, wherein the guide is configured as a guide rail, with the rollers resting on the surfaces of the guide rail.

11. The refrigeration appliance of claim 10, wherein the guide rail is a rib or groove, which extends along a side wall of the housing.

12. The refrigeration appliance of claim 11, wherein the mutually opposing surfaces of the guide rail are side faces of the rib or groove.

13. The refrigeration appliance of claim 1, wherein the guide is configured as a guide rail, said guide rail and one of the toothed profiles being part of at least one of the first support profile and the second support profile which is fitted on an edge between a rear wall and a side wall of the housing.

14. The refrigeration appliance of claim 1, wherein the two opposing surfaces comprise two opposing outer surfaces, the two rollers respectively resting on the two opposing outer surfaces.

15. The refrigeration appliance of claim 1, wherein the two opposing surfaces comprise two opposing inner surfaces, the two rollers respectively resting on the two opposing inner surfaces.

* * * * *